United States Patent [19]

Sorimachi

[11] 4,371,859

[45] Feb. 1, 1983

[54] COIL SPRING BIASED CURRENT LIMITER

[75] Inventor: Mitsuo Sorimachi, Isesaki, Japan

[73] Assignee: Hosiden Electronics Co., Ltd., Osaka, Japan

[21] Appl. No.: 281,431

[22] Filed: Jul. 8, 1981

[30] Foreign Application Priority Data

Aug. 22, 1980 [JP] Japan ..... 55-118850[U]

[51] Int. Cl.[3] ..... H01H 37/54; H01H 37/74

[52] U.S. Cl. ..... 337/365; 337/91; 337/343

[58] Field of Search ..... 337/365, 53, 89, 91, 337/342, 343, 348, 365, 367

[56] References Cited

U.S. PATENT DOCUMENTS 2,262,205 11/1941 Schachtner ..... 337/53
2,775,667 12/1956 Greenawalt ..... 337/56
2,911,503 11/1959 Garbers ..... 337/91
3,846,729 11/1974 Sorimachi ..... 337/343

*Primary Examiner*—Harold Broome
*Attorney, Agent, or Firm*—Pollock, Vande Sande & Priddy

[57] ABSTRACT

First and second fixed terminals are mounted in a casing and have one ends projecting out of the casing. Inside the casing, a bimetal extends between the first and second fixed terminals, the bimetal having one end secured to the first fixed terminal. The other end of the bimetal is held in engagement with one end of a coil spring disposed around a pivotable lever pivotably supported on the casing, the other end of the coil spring engaging the pivotable lever. When a current flowing through the bimetal exceeds a predetermined amount, the bimetal is bent to cause a contact supported on a distal end thereof to move rapidly out of contact with a contact supported on the second fixed terminal under the resiliency of the coil spring acting on the bimetal.

9 Claims, 6 Drawing Figures

COIL SPRING BIASED CURRENT LIMITER

BACKGROUND OF THE INVENTION

1. Field of the Invention

The present invention relates to a current limiter for cutting off a current path when a current flowing therethrough exceeds a predetermined limit.

2. Prior Art

A conventional current limiter as disclosed in U.S. Pat. No. 3,846,729 entitled "Current Limiter" issued on Nov. 5, 1974 comprises a bimetal having one end secured to a first fixed terminal, and a semielliptic spring having one end held in engagement with the other free end of the bimetal to urge the latter so as to be compressed longitudinally thereof. When the free end of the bimetal is located in a critical line extending between the other end of the semielliptic spring and the secured end of the bimetal, the free end of the bimetal is unstable and tends to get stabilized in position by moving to either side of the critical line. The current limiter also includes a second fixed terminal disposed at one of the stable positions of the bimetal and normally in contact with the free end of the bimetal. When a current which flows between the first and second stationary terminals via the bimetal is below a predetermined amount, the bimetal remains as it is without being bent. When the current exceeds such a predetermined value, then the bimetal becomes curled due to Joule's heat generated, enabling its free end to move across the critical line toward the other stable position away from the second fixed terminal. Thus, the current path between the first and second fixed terminals is cut off. The prior current limiter is advantageous in that the bimetal may be slightly springy, can be reduced in thickness, may be of a high resistance, and can be put into operation with a relatively small current. Even if the bimetal is of a relatively large thickness, it can be assisted by the semielliptic spring for rapid cut-off operation.

The semielliptic spring of the known current limiter, however, tends to fatigue during repetitive operation. Such a disadvantage is not negligible especially with current limiters of the automatic return type because when the bimetal is returned to its original position at a reduced temperature after it has cut off the current path, the bimetal may again be curled off soon by a current flowing therethrough which exceeds the predetermined amount. Thus, the bimetal is caused to make and break the circuit repeatedly, resulting in rapid fatigue of the semielliptical spring and malfunctioning of the current limiter.

With current limiters of a conventional design, the bimetal must have a greatly reduced resistance in order to be actuatable by a high current such as 20 (A) or more. Therefore, the bimetal must have an increased thickness resulting in an increased degree of stiffness thereof, with the result that the semielliptical spring is required to have increased resiliency. To meet such a requirement, the semielliptical spring should be made of a material having increased modulus of elasticity, such as stainless steel, with an increased thickness. As the thickness of the semielliptical spring is increased, the maximum stress thereof is reduced in inverse proportion, and the spring is the more liable to get bent, with the consequence that the semielliptical spring will have a much shorter service life. With the semielliptical spring being of an increased resiliency, it becomes difficult to assemble in place and cannot be reliably held in engagement with the bimetal. Where the semielliptical spring has a hole therein for engagement with the bimetal, the spring has a tendency to get deformed at the hole during assembly or operation.

SUMMARY OF THE INVENTION

It is an object of the present invention to provide a current limiter which has a long service life enduring repeated use.

Another object of the present invention is to provide a current limiter which is actuatable with a relatively large current.

Still another object of the present invention is to provide a current limiter energizable with less irregular operating currents.

Still another object of the present invention is to provide a current limiter which can double as a manually-actuatable switch.

According to the present invention, a current limiter includes first and second fixed terminals which are mounted in an insulating casing and have one ends projecting out of the casing, and a plate-like bimetal housed in the casing and extending between the first and second fixed terminals, one end of the bimetal being secured to the first fixed terminal. A coil spring which is held substantially in alignment with the bimetal has one end engaging the other or distal end of the bimetal and is disposed around a pivotable lever which is pivotably supported at one end thereof on the casing. The coil spring is held at the other end thereof against the pivotable lever to bias the bimetal toward its fixed end. The point of engagement between the bimetal and the coil spring is positionally stable on either side of a critical line extending between the pivotably supported end of the pivotable lever and the fixed end of the bimetal. The distal end of the bimetal is pressed against the second fixed terminal when held in one of the stable positions. When a current flowing through the bimetal between the first and second fixed terminals exceeds a predetermined amount, the bimetal starts to be bent to cause the point of engagement between itself and the coil spring to move across the critical line, whereupon such point rapidly travels toward the other stable position under the resiliency of the coil spring to separate the bimetal out of contact with the second fixed terminal.

The coil spring which normally urges the bimetal is less subject to fatigue than a semielliptical spring is, and hence has a longer service life. The coil spring can be of a small size for a required degree of resiliency and can have a greater stiffness than that of the bimetal, with the result that the bimetal can be of an increased thickness to allow the current limiter to be actuatable at an operating current of 20 (A) or more. The coil spring, even with an increased stiffness, can easily be assembled into the casing.

The above and other objects, features and advantages of the present invention will become apparent from the detailed description when taken in conjunction with the accompanying drawings which illustrate preferred embodiments by way of example.

DESCRIPTION OF THE PREFERRED EMBODIMENTS

Figure 1:
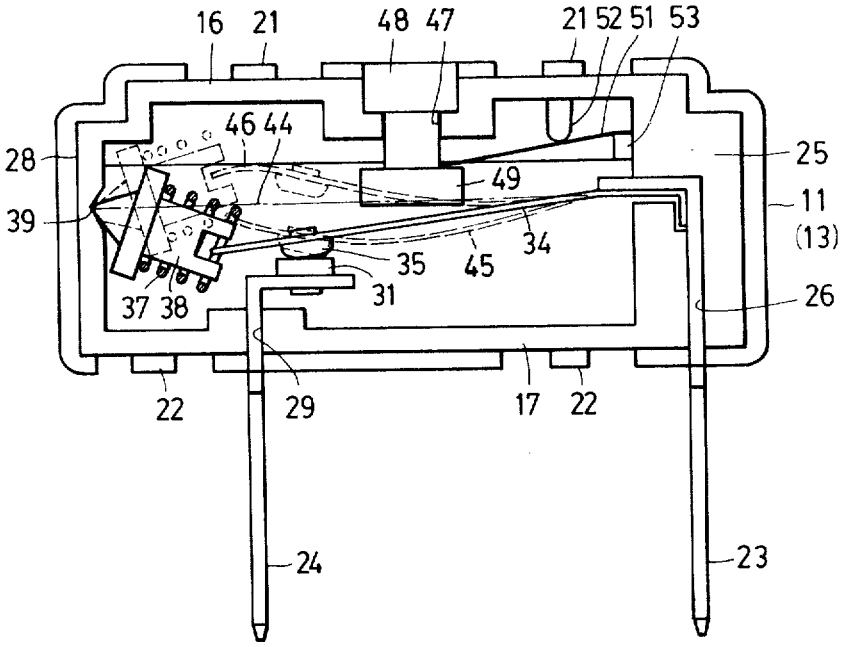
FIG. 1 is a front elevational view of a current limiter according to an embodiment of the present invention, with a front plate of the current limiter being removed.

In FIGS. 1 through 5, a casing 11 is molded of plastics material and is in the form of a rectangular parallelepiped. The casing 11 comprises a front plate 12 and a casing body 13 which are separate from each other and are coupled together. The front plate 12 has on its upper and lower edges tongues 14, 14 and 15, 15, respectively, extending perpendicularly from the front plate 12 and having holes 18, 18 and 19, 19, respectively. The casing body 13 has top and bottom plates 16, 17 having projections 21, 21 and 22, 22, respectively, and an opening between the top and bottom plates. The front plate 12 and the casing body 13 can be assembled together by placing the tongues 14, 14 and 15, 15 of the front plate 12 rearwardly onto the top and bottom plates 16, 17, respectively, of the casing body 13 until the front plate 12 covers the opening of the casing body 13, and the projections 21, 21 and 22, 22 are snappingly fitted respectively into the holes 18, 18 and 19, 19 in the tongues 14, 14 and 15, 15.

Figure 5:
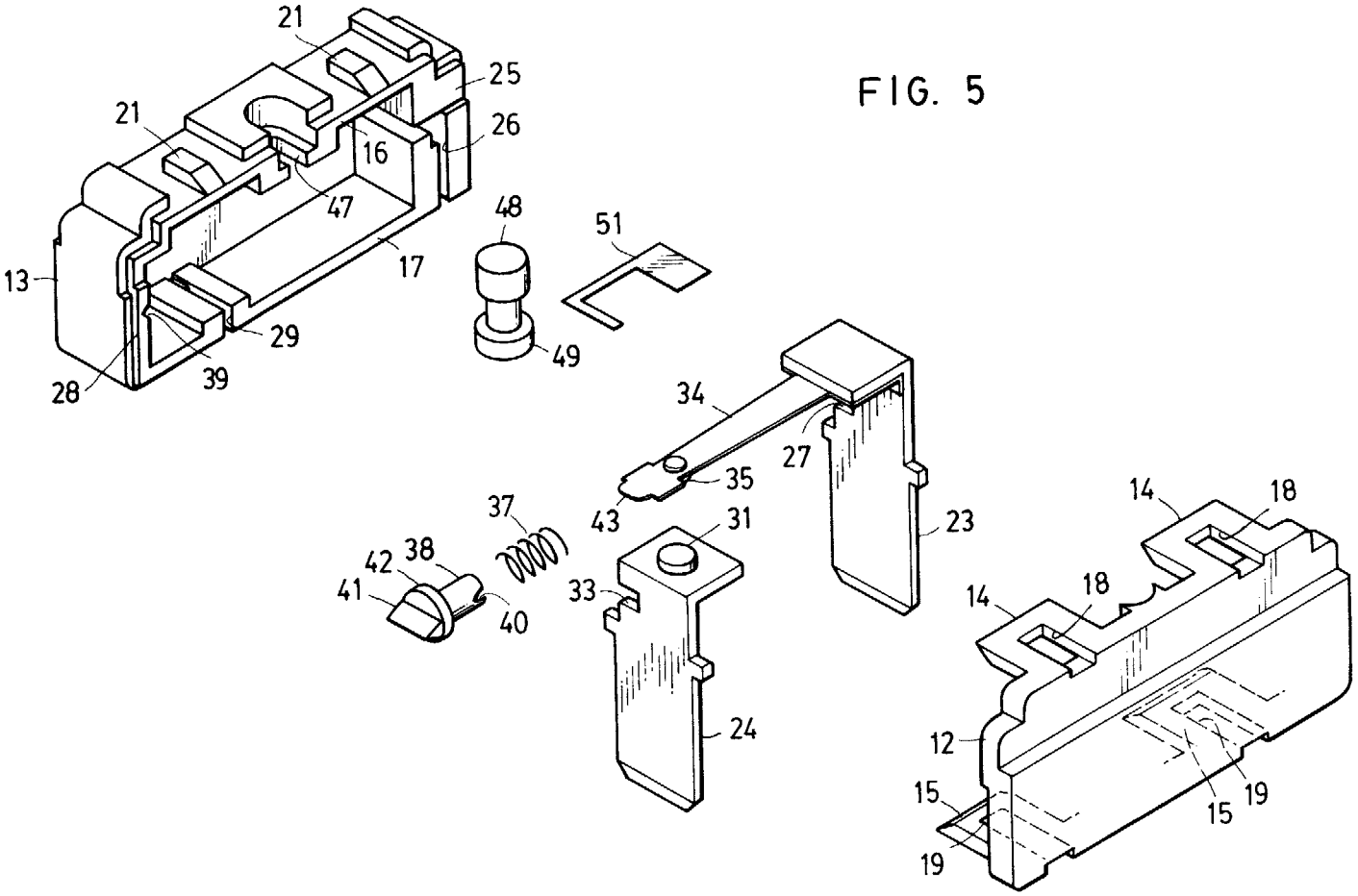
FIG. 5 is an exploded perspective view of the current limiter illustrated in FIG. 2.

A pair of fixed plate-shaped terminals 23, 24 are mounted in the casing 11 and have one or outer ends projecting out of the casing 11. The fixed terminal 23 is made of a material such as brass and has an L-shaped inner end portion, as illustrated in FIGS. 1 and 5. The casing body 12 has a side plate 25 having an inverted L-shaped slot 26 in a surface thereof facing the front plate 12, the L-shaped inner end portion of the terminal 23 being pressed-fitted in the slot 26. The L-shaped inner end portion of the terminal 23 has an inner end projecting out of the side plate 25 into the casing 11. The outer end of the terminal 23 projects out of the casing 11 through the bottom plate 17. The terminal 23 has in an edge thereof a recess 27 (FIG. 5) in which there is fitted a projection (not shown) in the slot 26 for positioning the terminal 23. The bottom plate 17 of the casing body 13 has a thickened portion located off center toward a side plate 28 and having a slot 29 in which there is press-fitted the terminal 24 which is also made of a material such as brass and has an inner end portion bent substantially at a right angle so as to be directed toward the side plate 25. The bent end portion of the terminal 24 supports thereon a fixed contact 31. The terminal 24 is held vertically in position by a projection (not shown) in the slot 29 which fits in a recess 33 (FIG. 5) in the terminal 24.

A bimetal 34 is housed in the casing 11 and extends between the terminals 23, 24. The bimetal 34 has one end secured to the inner end of the terminal 23 as by spot welding or staking, and supports on a distal end portion a movable contact 35 disposed in confronting relation to the fixed contact 31.

According to the embodiment illustrated, a compression coil spring 37 and a pivotable lever 38 are mounted in the casing 11 in place of a conventionally used semielliptical spring. The distal end of the bimetal 34 is held in engagement with one end of the coil spring 37 so as to be biased toward the fixed end thereof. The other end of the coil spring 37 is held against the pivotable lever 38, which is pivotally supported by the casing 11. More specifically, the side plate 28 of the casing 11 has a groove 39 therein which is of a triangular cross section and extends perpendicularly to the sheet of FIG. 1. The pivotable lever 38 has on its one end a ridge 41 (FIG. 5) which has a triangular cross section and is received in the groove 39. The pivotable lever 38 has a flange 42 disposed adjacent to the ridge 41 and held in engagement with the other end of the coil spring 37 which extends around the pivotable lever 38. The pivotable lever 38 has in its other end an axial recess 40 opening away from the ridge 41. As shown in FIG. 5, the distal end of the bimetal 34 has its corners removed to define shoulders and an engagement tongue 43 which is inserted with a press to fit into said one end of the coil spring 37, with the shoulders being held against the end of the coil spring 37. As assembled, the compression coil spring 37 urges the pivotable lever 38 against the side plate 28 and at the same time urges the bimetal 37 toward the side plate 25, so that the pivotable lever 38 is retained in position within the casing 11 so as to be angularly movable about a point of engagement of the ridge 41 with the bottom of the groove 39. The end of the coil spring 37 which engages the bimetal 34 should preferably be located so as to lie flush with or to be displaced toward the flange 42 beyond the end of the pivotable lever 38 which is remote from the ridge 41. Thus, the coil spring 37 is substantially disposed around the pivotable lever 38 so that the axis of the coil spring 37 will not be deflected. The engagement tongue 43 of the bimetal 34 should preferably be positioned within the recess 40 but out of contact with the pivotable lever 38.

A critical line 44 (FIG. 1) which extends between the point of engagement of the ridge 41 with the bottom of the groove 39 and the fixed end of the bimetal 34 provides on its upper and lower sides two stable positions for the distal end of the bimetal 34. More specifically, when the distal end of the bimetal 34 is positioned in the one of such two stable locations which is below the critical line 44, the movable contact 35 is biased to stay in contact with the fixed contact 31 under a vertically downward component of the resilient biasing force from the coil spring 37.

When a current flowing through the bimetal 34 between the terminals 23, 24 is below a predetermined amount, the temperature of the bimetal 34 which is determined by the Joule's heat generated in the bimetal 34 and the heat radiated therefrom is not sufficiently high to bend the bimetal 34 against the biasing force of the coil spring 37 and hence the bimetal 34 remains held in the lower stable position without being bent or curled. When the current flowing through the bimetal 34 exceeds the predetermined value, the heat generated by the bimetal 34 becomes enough to raise the temperature of the bimetal 34 higher to the point where the bimetal 34 is bent into a shape shown by the broken lines 45 in FIG. 1. As the point of engagement between the bimetal 34 and the coil spring 37 goes up across the critical line 44, the bimetal 34 quickly springs upwardly into the upper stable position above the critical line 44 as illustrated by the broken lines 46. Therefore, the movable contact 35 is forced to be disengaged rapidly from the fixed contact 31 for cutting off the current path between the terminals 23 and 24.

The current limiter according to the illustrated embodiment includes means for displaying the condition in which the current path is cut off and for resetting the bimetal. More specifically, the top plate 16 of the casing 11 has a central through aperture 47 in which there extends the shaft of a reset button 48 having on its inner end a flange 49 disposed above and closely to the bimetal 34. The aperture 47 has an enlarged or large-diameter portion opening upwardly which receives therein a head of the reset button 48. The head has its upper surface lying normally flush with an outer surface of the casing 11. As the distal end of the bimetal 34 is caused to move upwardly away from the fixed contact 31, the bimetal 34 lifts the reset button 48 outwardly of the casing 11 to indicate that the circuit is broken. By then depressing the reset button 48 into the casing 11 to force the distal end of the bimetal 34 to descend across the critical line 44, the movable contact 35 is urged into contact with the fixed contact 31 and stably held at the lower stabilized position. To provide against accidental popping-up of the reset button 48, which may take place depending on how the casing is postured, there is provided a leaf spring 51 of a relatively reduced resiliency having one end held in engagement with the flange 49 and the other end retained by projections 52, 53 on the casing 11 to normally bias the reset button 48 into the casing 11.

With the current limiter thus constructed according to the present invention, the current can be cut off momentarily, and a thin bimetal can be used for operation with a small current; thus the functional features are the same as those gained by the prior current limiter disclosed in the U.S. Pat. No. 3,846,729 described before. However the current limiter according to the present invention is additionally advantageous in that the coil spring 37 is subjected to less fatigue during repeated use than that the prior semielliptical spring has experienced, and hence the current limiter enjoys a longer operating life, particularly suitable for use as a current limiter of the automatic return type. Since the coil spring may be small in size but can be large in stiffness, the bimetal 34 can be of an increased thickness for operation at a large current of 20 (A) or more. Even if the spring has an increased stiffness, it exhibits a high resiliency and hence will not exceed the limit of elasticity when it is bent to a considerable degree. The bimetal can be combined with the coil spring simply by inserting the former into the latter. In the prior art current limiter where a bimetal having a hole for engagement with a semielliptical spring is used, the portion of the bimetal around the hole was mechanically weak, resulting in a short service life. On the contrary, in the present invention the bimetal does not have such a hole, thus the current limiter of the present invention has greater longevity.

The pivotable lever 38 is disposed in the coil spring 37 in loose contact with an inner peripheral surface thereof, and the coil spring 37 does not project axially beyond the pivotable lever 38. Thus, the axis of the coil spring 37 is prevented by the pivotable lever 38 from being deflected or curved, with the consequence that the current limiter will be actuated at less irregular operating currents. Furthermore, since the engagement tongue 43 of the bimetal is force-fitted into the coil spring 37 and held out of contact with the pivotable lever 38, the bimetal can be reliably shifted from one of the stable positions to the other each time the point of engagement between the bimetal 34 and the coil spring 37 shifts across the critical line 44, allowing a constant operating current to be available for the current limiter. The engagement tongue 43 should not be allowed to contact the pivotable lever 38 because with such contact allowed, the bimetal 34 would be shifted from one of the stable positions to the other either when the point of such contact gets across the critical line 44 or when the point of engagement between the bimetal 34 and the coil spring 37 gets across the critical line 44, thus producing a disadvantage which is likely to result in current limiters having irregular operating currents.

As the casing body 13 is molded to a relatively high degree of dimensional precision and the terminals 23, 24 are positioned by the positioning means on the casing body 13, current limiters can be mass-produced which have an equally positioned critical line 44 and identical characteristics.

Figure 6:
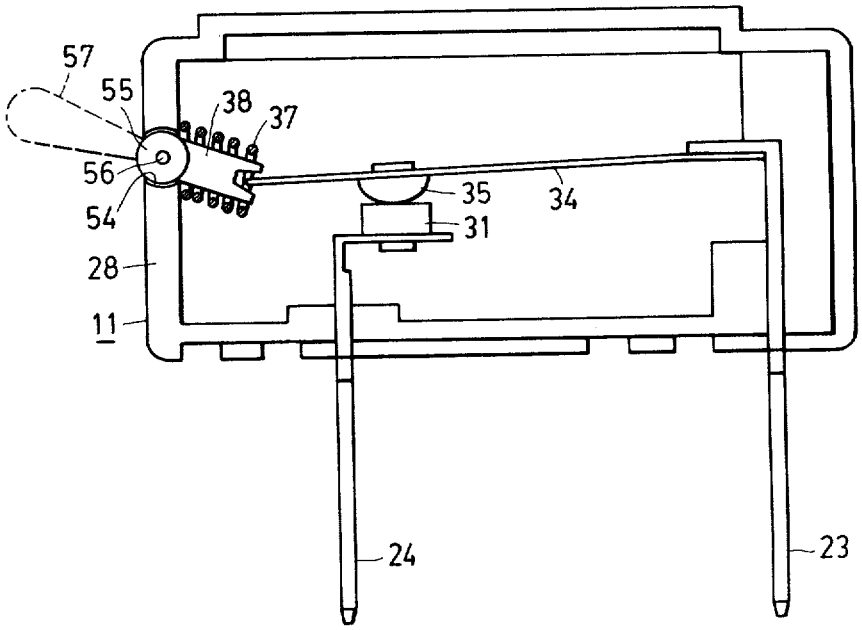
FIG. 6 is a front elevational view of a current limiter according to another embodiment of the present invention.
Figure 2:
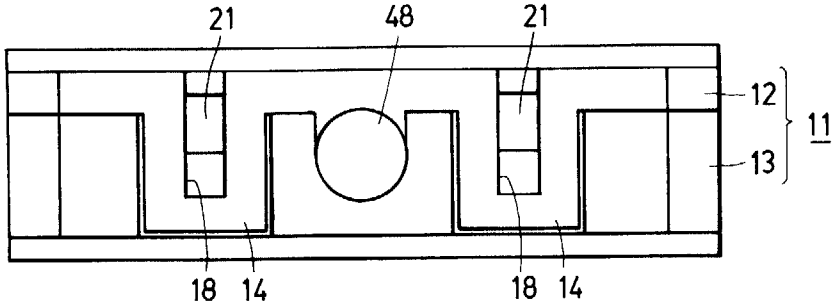
FIG. 2 is a plan view of the current limiter shown in FIG. 1.
Figure 3:
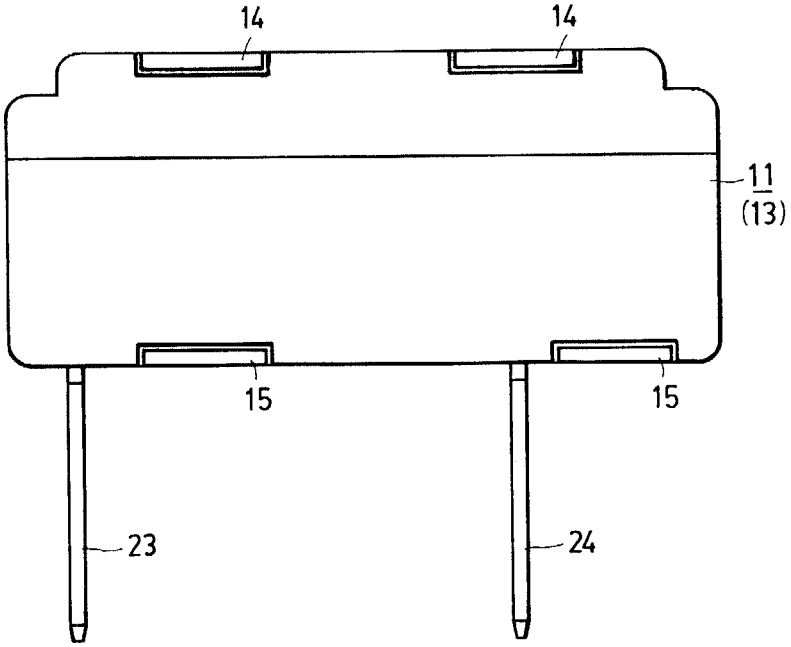
FIG. 3 is a front view of the current limiter of FIG. 2.
Figure 4:
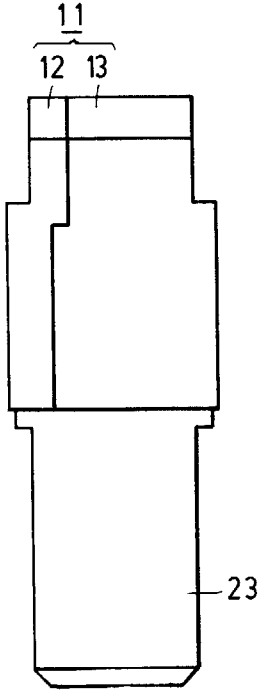
FIG. 4 is a left side elevational view of the current limiter of FIG. 3.

FIG. 6 shows another arrangement for supporting the lever 38 pivotably on the casing 11. More specifically, the side plate 28 has in its edge facing the front plate a bearing hole 54 receiving therein a disc portion 55 attached to an end of the pivotable lever 38 and angularly movable in the bearing hole 54 about its own axis. The disc portion 55 has a pivot pin 56 journalled at its opposing ends in holes (not shown) in the front plate and the side plate 28 for smooth pivotable movement of the disc portion 55. A knob 57, shown by the broken line, may be attached to the disc 55, the knob 57 extending out of the casing 11 away from the pivotable lever 38. The knob 57 can serve not only to reset the current limiter as actuated, but also as a switch to bring the movable contact 35 into and out of contact with the fixed contact 31 upon manual pivotal movement thereof, for thereby turning on and off the current limiter. In FIG. 1, the reset button 48 may be dispensed with, and the current limiter can be reset by depressing the bimetal with, for example, a screwdriver inserted into the casing 11 through the aperture 47. The current limiter may be arranged so as to be automatically reset without relying on the reset means illustrated.

Slight irregularities in characteristics can be corrected by changing the angle at which the inner end portion of the terminal 24 is bent, thus adjusting the height of the fixed contact 31 from the bottom plate 17. For current limiters having a large current requirement and hence a thick terminal 24, the inner end portion thereof to be bent should preferably be of a reduced thickness as shown in FIG. 6 to facilitate bending of the inner end portion of the terminal for effecting such adjustment.

Although certain preferred embodiments have been shown and described in detail, it should be understood that various changes and modifications may be made therein without departing from the appended claims.

What is claimed is:

1. A current limiter comprising:

(a) a casing made of an insulating material;

(b) a first fixed terminal mounted in said casing and having one end projecting out of the casing;

(c) a plate-like bimetal housed in said casing and having one end secured to said first fixed terminal, said bimetal supporting a movable contact;

(d) a coil spring having one end held in engagement with the distal end of said bimetal and positioned substantially in alignment with the bimetal, said distal end of the bimetal having an engagement tongue of a reduced width with shoulders on each side thereof, said engagement tongue being inserted in said coil spring with said shoulders held against said one end of the coil spring;

(e) a pivotable lever pivotably supported in said casing and disposed in said coil spring in engagement with the other end of the coil spring, said pivotable lever being fitted substantially in said coil spring to prevent the axis of the coil spring from becoming deflected, said coil spring urging said bimetal toward said one end thereof and said pivotable lever against said casing; and (f) a second fixed terminal mounted in said casing and having one end projecting out of the casing, said second fixed terminal supporting a fixed contact, said movable contact on the bimetal being normally held against said fixed contact on the second fixed terminal under the bias of said coil spring.

2. A current limiter according to claim 1, wherein said one end of the coil spring lies substantially flush with the end of said pivotable lever which is adjacent to said bimetal, said end of the pivotable lever having a recess receiving therein the distal end of said bimetal.

3. A current limiter according to claim 1, wherein said engagement tongue of the bimetal is press-fitted into said coil spring.

4. A current limiter according to claim 1, wherein said pivotable lever has at its end remote from said bimetal a ridge of a triangular cross section, said casing having in its inner wall a groove of a triangular cross section extending substantially in parallel to the plane of said bimetal and receiving therein said ridge of the pivotable lever, said pivotable lever being pivotably supported in said casing by engagement of said ridge in said groove and by engagement of said coil spring with said bimetal.

5. A current limiter according to claim 1, wherein said pivotable lever is pivotably supported in said casing by a pivot pin extending substantially parallel to a widthwise direction of said bimetal substantially in alignment with the bimetal.

6. A current limiter according to claim 5, including a knob attached to said pivot pin and extending out of said casing away from said pivotable lever.

7. A current limiter according to claim 6, wherein said casing has in a wall thereof a bearing hole in which said pivot pin is disposed.

8. A current limiter according to claim 1, wherein said second fixed terminal has a thin portion adjacent to said fixed contact to facilitate positional adjustment of said fixed contact with respect to said movable contact on the bimetal.

9. A current limiter according to claim 1 wherein said casing is molded and has means for holding said first and second fixed terminals in position.

* * * * *